United States Patent [19]

Barnewall

[11] Patent Number: 5,002,801

[45] Date of Patent: Mar. 26, 1991

[54] PAPER MACHINE FABRICS HAVING CONTROLLED RELEASE

[75] Inventor: James M. Barnewall, Albany, N.Y.

[73] Assignee: Albany International Corp., Albany, N.Y.

[21] Appl. No.: 265,246

[22] Filed: Oct. 31, 1988

[51] Int. Cl.[5] ..... B05D 1/00; B05D 5/00

[52] U.S. Cl. ..... 427/209; 427/244; 427/386; 427/387; 427/389.9; 428/265; 428/266

[58] Field of Search ..... 427/244, 373, 209, 386, 427/387, 389.9; 162/DIG. 1; 428/265, 266

[56] References Cited

U.S. PATENT DOCUMENTS 4,172,910 10/1979 Rotar ..... 427/245 X
4,495,227 1/1985 Tanaka ..... 427/373
4,515,646 5/1985 Walker et al. ..... 427/244 X
4,618,530 10/1986 Stetson ..... 427/244 X

*Primary Examiner*—Michael Lusignan
*Attorney, Agent, or Firm*—Kane, Dalsimer, Sullivan, Kurucz, Levy, Eisele & Richards

[57] ABSTRACT

This invention is directed to paper machine fabrics having controlled release of chemicals. More particularly, this invention is directed to a method for achieving controlled release of chemicals and a method of modifying a felt for a papermaking machine which comprises the steps of:

(a) preparing a foam comprising resin and a chemical such as a detergent, surfactant, or other chemical modifier;

(b) applying said foam from step (a) to the surface of said fabric; and (c) permitting said foam mixture to dry and cure.

10 Claims, No Drawings

PAPER MACHINE FABRICS HAVING CONTROLLED RELEASE

FIELD OF THE INVENTION

This invention is directed to paper machine fabrics having controlled release of chemicals. More specifically, this invention is directed to a method for achieving controlled release of chemicals from paper machine fabrics by coating the fabrics with foamed resins.

BACKGROUND OF THE INVENTION

The modern papermaking machine is in essence a device for removing water from the paper furnish. The water is removed sequentially in three stages or sections of the machine. In the first or forming section, the furnish is deposited on a moving forming wire, and water is drained through the wire to leave a paper sheet or web having a solids content of from about 14 to 30 percent by weight. The formed web is carried into a press section and passed through one or more press nips on a moving press fabric to remove sufficient water to form a sheet having a solids content of from about 36 to 50 percent by weight. This sheet is transferred to the dryer section of the papermaking machine where drying fabrics press the paper sheet to hot steam heated cylinders to obtain a final paper sheet dryness of from about 92 to 96 percent solids content.

On papermaking machines, endless belts are employed in the various sections to carry the sheet or web of paper. There are a wide variety of forms of the endless belts, some fabricated from metal and others from textile material such as cotton, glass, or wool, or synthetic fibrous or filamentous material such as polyamide or polyester. The selection of a given material is dependent to some degree upon the use to which the fabric will be put, i.e., as a forming fabric, press fabric, drying fabric, etc.

One form of belt which has been used extensively as a forming medium in the forming section of the papermaking machine is one fabricated from an open weave of synthetic, polymeric resin monofilaments. Such fabrics generally perform well in the forming section although there are certain limitations. For example, these monofilaments have an affinity for accumulating a build-up of pitch, tars, and other contaminants during use. This shortens the overall life of the forming fabric and can require frequent halts of the papermaking machine for mechanical cleaning and application of chemicals. Such shut-down cleaning may be required as frequently as on a weekly basis.

Those skilled in the art have long appreciated that the efficiency of water removal in the press section of the papermaking machine is critical to overall efficiency in the papermaking process. There are two reasons for this:

First, a large amount of water must be removed from the sheet at the presses to realize a good drying economy. And second, greater efficiency in water removal creates a drier and hence stronger sheet less susceptible to breaking.

A large variety of clothing constructions have been proposed as papermakers' press fabrics advantageously employed in the press section of a papermaking machine. In fact, there has been a continual evolution of clothing constructions, corresponding to improvements in the papermaking machine itself. This evolution began with the early woven felt, woven of spun yarn and then mechanically felted or fulled. A later development was found in the "Batt-on-Base" construction consisting of a woven fabric base and a batt surface attached by needling. The needled Batt-on-Mesh fabrics of multifilaments and monofilaments are widely used today and have been said to be the "standard of the industry." However, a wide variety of other constructions are available, including non-woven press fabrics and composite laminates which comprise two or more separate base fabrics. See, for example, U.S. Pat. Nos. 2,567,097, 3,059,312, and 3,617,442, all of which are incorporated herein by reference.

The fabrics for us in the drying section of the papermaking machine have historically been called dryer felts. In recent years, one form of fabric commonly employed in the dryer section of a papermaking machine is referred to as a "screen" and is fabricated by weaving synthetic monofilaments or twisted multifilaments together in an open weave. These screen fabrics have also become known as "drying fabrics". These drying fabrics are generally woven flat, and the ends are thereafter joined to form an endless fabric. The weave selected may be a one, two, or three layer weave of synthetic yarns such as multifilament, spun, or, most commonly, monofilament yarns.

In carrying the paper web through the dryer section of the papermaking machine, the fabric aids in sheet drying, controls shrinkage of the paper web, and prevents cockles. The fabric must possess strength, dimensional stability, and resistance to abrasion and have a functional permeability. In recent years all monofilament structured fabrics have been developed to meet the above-described needs of a drying fabric. However, drying fabrics fabricated from all monofilament fabrics, similarly to forming wires, accumulate deposits of pitch, tar, and other contaminants such as paper fines and fillers. Shut-down cleaning may be required as frequently as every 2 to 3 weeks, and cleaning over a long period of time may become less effective as filling of the fabric voids continues. This, of course, would most undesirably result in a high percentage of unsatisfactory paper product.

In general, the papermakers' forming fabrics, press fabrics, and drying fabrics require periodic mechanical and/or chemical cleaning to remove debris or contaminants which accumulate during use. Certain chemical additives are also advantageously used during initial break-in periods. For example, it is common to use small amounts of a detergent applied through a full width shower on press fabrics during the running life of the fabrics. The use of such a detergent shower is intended for conditioning a press fabric to be more able to accept water from the sheet and thus aid a fabric in keeping clean and draining properly. It is also known from prior art that the use of free detergent dissolved in the stock water aids in pressing water from the sheet of paper being produced.

According to U.S. Pat. No. 4,569,883, paper machine fabrics are treated with chemicals which are dispensed or released while the fabric is in motion. However, it would be advantageous to have chemicals released more slowly than they are according to this patent.

Dispensing of small quantities of surfactant throughout the life of the press fabric is beneficial. However, since difficulty in pressing water from paper is mostly experienced in the initial few days and during the compaction of the fabric to its equilibrium caliper (thickness), the addition of surfactant during this break-in period is most beneficial.

During break-in it is also important to keep the fabric clean so that paper stock particles are not trapped within the press fabric, thus impeding uniform sheet water drainage. The surfactant would act as a cleaning agent as well. It is also possible to minimize cost and foam buildup since this method reduces the amount needed, if applied via a shower, because dispensing of the surfactant is controlled and at the fabric/paper interface.

With the structured fabrics of the present invention, many of the above-described shortcomings of the prior art are removed. Drying fabrics constructed according to the invention may be fabricated from an all monofilament fabric which provides for extended periods of time an exceptionally smooth surface to contact the paper sheet. As a result, relatively mark free paper product is obtained, while all of the desired advantages of an all monofilament drying fabric are retained.

Press fabrics are broken-in more rapidly and require less frequent shut-down cleaning, thereby improving the efficiency of the papermaker's machine for a longer period of time. The overall operating life of the forming fabrics and press fabrics can be significantly increased over prior art.

OBJECTS OF THE INVENTION

It is an object of the invention to provide papermaking fabrics having controlled release of chemicals.

It is also an object of the invention to provide a method for controlling the release of chemicals from papermaking fabrics.

It is a further object of the invention to provide a method for achieving controlled release of chemicals from papermaking machine fabrics by coating the fabrics with foamed resins which entrap detergent.

These and other objects of the invention will become more apparent from the discussion below.

DETAILED DESCRIPTION OF THE INVENTION

Applicant has developed an improved fabric useful in papermaking machines. The invention comprises a fabric treated with detergent derived from a foam coating that has been applied, and said fabric is a significant improvement over known treated press fabrics. Papermaking fabrics coated according to the invention have the following advantages:

(1) Enhanced fabric cleanability;
(2) Increased resistance to filling;
(3) Increased and/or more uniform sheet/fabric dewatering for improved papermaking machine efficiency;
(4) Faster break-in; and
(5) Enhanced wet up/wettability.

The fabrics to be treated include those fabrics known in the art. Typical fabrics are described in, for example, U.S. Pat. Nos. 2,354,435, 3,158,984 3,425,392, 3,657,068, 4,382,987, and British Patent No. 980,288, all of which are incorporated herein by reference.

Useful resin compositions include synthetic, flexible, polymeric resin foams such as polyurethane. Also useful are foams based upon polyether, polyester, polyisocyanate foams, polyolefins, and the like, or a combination of two or more such polymeric resins. Typical of useful resin compositions are Emulsion 26172 (an acrylic Emulsion available from B.F. Goodrich), Permuthane HD2004 (a water-based polyurethane emulsion available from C.L. Hauthaway), and Aridall 1080 (a super absorbent acrylic polymer available from Chemdal Corp.).

Any of many known detergent and/or surfactant systems can be used according to the invention, including known anionic, cationic, or zwitterionic surfactant compositions. Examples of useful detergents include Triton X114 and Triton X200, each of which is available from Rohm & Haas Co.

The resin foam composition can be prepared by admixing the various components and then foaming or frothing the resulting mixture. In a preferred embodiment of the invention, water and detergent are mixed with a polymer to form a gel. The gel is then finely divided into microcapsules, and the microcapsules are dispersed into a polymeric emulsion. This emulsion is then frothed.

According to the invention this foam is applied to a surface, or surfaces, of a fabric, allowed to dry, and then cured. Drying and curing can each be effected by air drying at room temperature for a sufficient length of time or at elevated temperatures for from about 1 minute to 5 hours. The temperature and time for drying or curing will be dependent upon the foam employed, manufacturing conditions, and the like.

The drying and curing could be performed in separate steps or simultaneously. In some cases it may be desirable to calender the fabric after drying and before the curing step.

The foam could be applied by an number of known procedures which include, for example, blade coating techniques which can be on roll, off roll, or table; squeeze coating; transfer coating, spraying; kiss or applicator roll; slot applicator; and brush application. A single layer can be applied or multiple layers of the same or different foam formulations can be applied to obtain a given final result.

The resultant foam may reside entirely upon the surface of the fabric to the extent of 90% or more extending above the fiber surface plane, or it may be partially embedded into the surface to the extent of about 50%, leaving 50% above the surface. Otherwise the foam may lie primarily embedded in the fabric, penetrating partially or wholly into the fabric.

The thus modified fabric will have therein microcapsules containing chemical, which chemical will be released over time.

The following examples are intended to illustrate the invention and should not be construed as limiting the invention thereto. The examples employ detergents; however, other materials might be considered for slow release that would substantially alter surface or other fabric characteristics such as oleophobic, oleophilic, hydrophobic, hydrophilic, cationic, anionic, etc.

EXAMPLES

Example 1

A 50:50 by weight mixture of Emulsion 26172 and Permuthane HD2004 was prepared, and 10% by weight, based upon the weight of that mixture, of Triton X114 was added. The resultant mixture was stirred at room temperature in a bench top mixer until it foamed. The foam was applied to a sample of DURA-GROOVE TM fabric (available from Albany International Corp.), and a Gardner knife set at zero gap (scrape coating) was used to remove unabsorbed foam.

The coated fabric sample was dried in an oven and cured at 300° F. for 10 minutes, after which the coated fabric sample and an uncoated fabric sample were tested for air permeability. The original, uncoated fabric sample had an air permeability of 145 cfm, and the coated fabric had an air permeability of 49 cfm, as measured on the Frazier Air Permeability Tester. (Units are expressed as cubic feet of air passing through a square foot of fabric in one minute.)

Even though the coated fabric was partially filled with foam, it initially absorbed water at a rate about twice the original, as measured by a standard textile drop spread test.

Example 2

A solution of 50% by weight water and 50% by weight Triton X114 detergent was admixed into a super absorbent acrylic polymer (Aridall 1080) until a stiff gel was formed. The gel was finely divided in a blender and then dispersed into a urethane emulsion. The resultant mixture was frothed to a 21:1 blow ratio in a laboratory mixer at room temperature.

A sample from a trim strip of a DURAVENT TM fabric (available from Albany International Corp.) was coated in the same manner as in Example 1. The treated sample was dried in an oven and then cured at 300° F. for 10 minutes.

When the coated sample was subsequently washed, the detergent did not diffuse out of the fabric rapidly, as is normally the case, apparently due to entrapment by the gel. Also, the coated fabric wet up much faster than an uncoated fabric, which tends to be hydrophobic. Repeated washings and dryings did not reduce the rate of wetting up.

Example 3

A series of samples were prepared using the procedure outlined in Example 2. The foam mixture was coated onto the fabric samples at zero gap, 20 mils, and 50 mils. The fabric sample was from the same source as in Example 2.

Wettability was observed for the samples prepared in Example 3 using the "Beaker" test and the standard textile drop spread test. In the "Beaker" test, the sample, a one inch fabric disk, is placed face down on the surface of water, and the times are noted for wet through. The time to sink and the time for the first wet spot to appear on the disk are also noted.

In the drop spread test the time for a single drop to spread to its maximum limit on the fabric surface is measured. The uniformity of the drop spread differs from sample to sample. In some cases the drop spreads radially from the center and in others fingers travel randomly.

The data obtained on the samples is set forth in the following table:

TABLE I

| Sample | Time to First Wet Spot | Time to 100% Wet | Time to Submerge | Drop Spread |
|---|---|---|---|---|
| Control | >>5 Hrs. | >>>5 Hrs. | >>>5 Hrs. | Drop did not penetrate fabric |
| 0 Gap | 2 Sec. | 1.3 Min. | 3.7 Min. | 1.0 Sec. - uniform |
| 20 mil | 8 Sec. | 2.5 Min. | 3.2 Min. | 1.5 Sec. - uniform |
| 50 mil | 20 Sec | 3.0 Min. | 8.6 Min. | 2.0 Sec. - uniform |

It can be seen from Table I that the coated samples wet much more rapidly than the control and that the rate of wet up could be controlled by changing the thickness of the coating.

Example 4

Polyurethane water-based emulsion was loaded with 10% by weight of Triton X200 detergent and frothed into a stable low density foam. Due to the low density, several layers of froth could be squeegeed onto the fabric, which in this case was DURAGROOVE TM or DURAVENT TM. Non-uniformity of the coating was minimized by using several layers of low density foam, which tended to average out the non-uniformities of each individual layer.

Uncoated and coated fabric samples were tested for air permeability. The results were as follows:

TABLE II

| Sample | Fabric | Air Permeability (cfm/sq.ft.) |
|---|---|---|
| A* | Uncoated DURAGROOVE TM | 66 |
| B* | Coated DURAGROOVE TM | 63 |
| C* | Uncoated DURAVENT TM | 22 |
| D | Coated DURAVENT TM | 20 |

*Control

After the urethane coated samples were cured, they were washed, vacuumed, and dried for several cycles. The fabric surfaces still released detergent even after these washing and drying cycles.

Example 5

A froth wherein a detergent is encapsulated in urethane emulsion was prepared as described in Example 2. The froth was low density and very stable. This froth was applied to a DURAVENT TM fabric sample, and the sample was then passed over a vacuum slot on a dryer to draw the foam into the fabric The fabric was then dried and the urethane cured at 300° F.

After 12 repeated washings and dryings, the coated fabric sample continued to wet up more rapidly than the uncoated fabric sample.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A method of modifying fabric for a papermaking machine which comprises the steps of:

(a) preparing a foam comprising resin and one or more additives selected from the group consisting of wetting agents, surfactants, emulsifiers, foam stabilizers, and inert fillers by admixing water and an effective amount of said additive or additives to form a mixture, admixing said mixture with a polymer to form a gel, finely dividing the gel to form microcapsules, dispersing said microcapsules into a resin emulsion, and frothing the resulting emulsion to form a low density foam;

(b) applying an effective amount of said foam from step (a) to one or both of the surfaces of said fabric; and (c) permitting said foam mixture to dry and cure.

2. The method of claim 1, wherein the foam comprises a water-based polyurethane mixture.

3. The method of claim 1, wherein the foam comprises a water-based acrylic, epoxy, silicone, polyvinyl chloride, or polyether mixture.

4. The method of claim 1, wherein the drying and curing in step (c) is effected by air drying at elevated temperatures for from about 1 minute to 5 hours.

5. The method of claim 1, wherein in step (b), the surface or surfaces of the felt are contacted with foam and then unabsorbed foam is scraped off.

6. The method of claim 1, wherein the foam comprises a solvent-based polyurethane mixture.

7. The method of claim 1, wherein the foam comprises a solvent-based acrylic, epoxy, silicone, polyether, or polyvinyl chloride mixture.

8. The method of claim 1, wherein the polymeric foam is a combination of two or more resinous materials selected from the group consisting of polyurethane, polyacrylates, polyvinyl chloride, polyisocyanates, and polyacrylonitrile rubbers.

9. The method of claim 1, wherein the drying and curing in step (c) is effected by air drying at room temperature for sufficient time.

10. A papermaking fabric prepared according to the method of claim 1.

* * * * *